United States Patent [19]

Borel

[11] Patent Number: 4,569,375

[45] Date of Patent: Feb. 11, 1986

[54] COMPOSITE FABRIC FOR USE AS A CLOTHING FOR A PAPERMAKING MACHINE

[75] Inventor: Georg Borel, Reutlingen, Fed. Rep. of Germany

[73] Assignee: Hermann Wangner GmbH & Co. KG, Fed. Rep. of Germany

[21] Appl. No.: 683,968

[22] Filed: Dec. 20, 1984

Related U.S. Application Data

[63] Continuation of Ser. No. 507,070, Jun. 23, 1983.

[30] Foreign Application Priority Data

Jun. 29, 1982 [DE] Fed. Rep. of Germany ..... 3224187

[51] Int. Cl.[4] ..... D03D 15/00

[52] U.S. Cl. ..... 139/383 A; 139/425 A

[58] Field of Search ..... 139/383 A, 425 A, 408, 139/409, 410, 411, 412, 414; 162/DIG. 1

[56] References Cited

U.S. PATENT DOCUMENTS 2,857,654 10/1958 Sexton ..... 139/413

2,949,134 8/1960 Hindle et al. ..... 139/383 A 3,214,326 10/1965 Lee ..... 139/383 A 4,311,172 1/1982 Eckstein ..... 139/383 A 4,453,573 6/1984 Thompson ..... 139/383 A

FOREIGN PATENT DOCUMENTS 451752 8/1936 United Kingdom ..... 139/383 A

*Primary Examiner*—Henry S. Jaudon

*Attorney, Agent, or Firm*—John J. Torrente

[57] ABSTRACT

A composite fabric for use as a clothing in paper-making machines comprising a plurality of interconnected fabric layers, each fabric layer having interwoven longitudinal wires and transverse wires and the fabric layers being interconnected in that at least part of the transverse wires of one or both of two adjacent fabric layers are interwoven with the longitudinal wires of the other fabric layer, the interweaving of the transverse wires of the one fabric layer with the longitudinal wires of the other fabric layer being such that the course of the transverse wires of the one layer and the other layer are interchanged.

2 Claims, 6 Drawing Figures

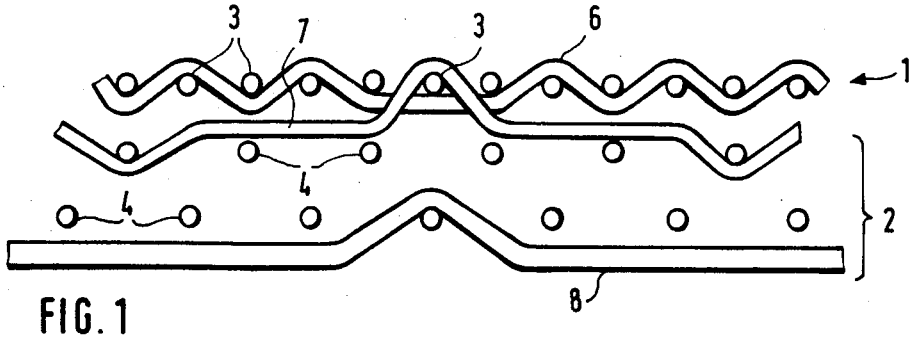
FIG. 1
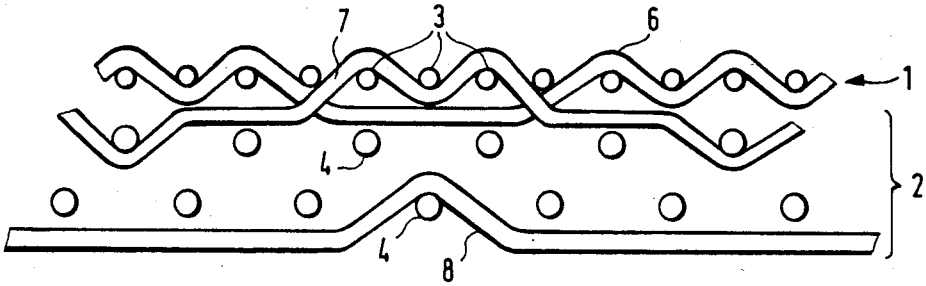
FIG. 2
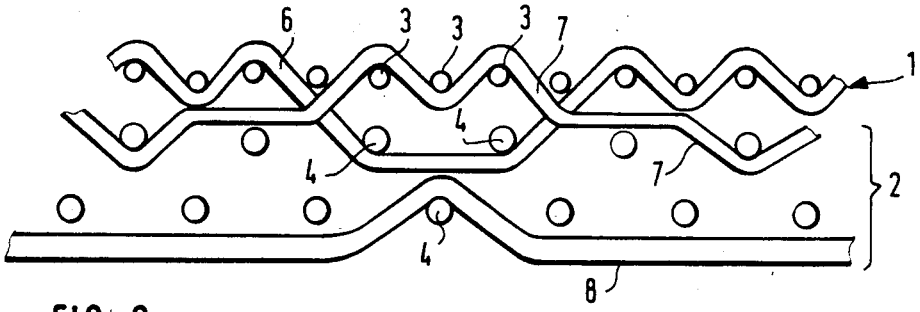
FIG. 3
FIG. 4
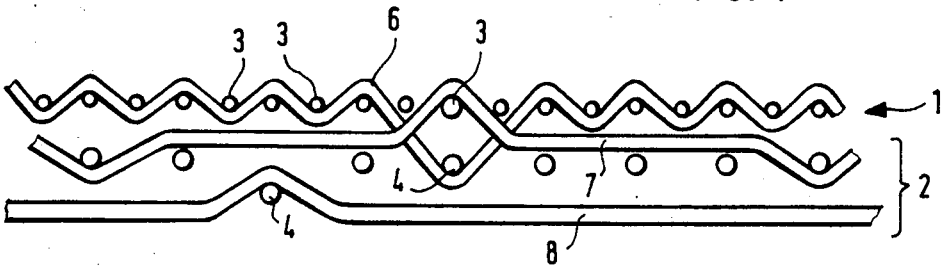

COMPOSITE FABRIC FOR USE AS A CLOTHING FOR A PAPERMAKING MACHINE

This application is a continuation of application Ser. No. 507,070, filed June 23, 1983.

BACKGROUND OF THE INVENTION

This invention relates to a composite fabric for use as a clothing in the sheet forming zone of a papermaking machine.

Clothings of the aforementioned type are referred to as papermachine screens and are frequently comprised of two or three fabric layers which are complete in themselves and are interconnected by additional binder wires. In these types of clothings the lowermost fabric layer is made from relatively coarse threads or wires, since it is subject to considerable wear. The topmost fabric layer, on the other hand, since it supports the sheet of paper pulp, is made from fine wires so that it leaves no marks in the paper. While clothings structured in this manner were expected to result in negligible marking and to provide long service life and high stability, practical experience has not proven this out.

German patent applications (OS) Nos. 2,455,184, 2,455,185 and 2,917,694 disclose clothings comprised of a plurality of interconnected fabric layers. Each layer has interwoven longitudinal and transverse wires and the layers are exclusively interconnected by transverse binder wires. Unfortunately, clothings of this type have not reached their expected long service life, because the transverse wires are seriously degraded after a relatively short time of operation.

Canadian Pat. No. 711,428 and European patent application No. 0 044 053 disclose joining two fabric layers by interweaving the transverse wires of the lower fabric layer with the longitudinal wires of the upper fabric layer at regular intervals without the use of special transverse binder wires. However, with these composite fabrics, the risk of marking is very high.

It is, therefore, an object of the present invention to provide a composite fabric for use as a clothing in the sheet forming zone of a papermaking machine which causes but slight marking while having a long useful life.

SUMMARY OF THE INVENTION

In accordance with the principles of the present invention, the above and other objects are realized in a composite fabric of the above type wherein the interweaving of the transverse wires of a first fabric layer with the longitudinal wires of a successive or adjacent second fabric layer is such that the courses of the transverse wires of the first fabric layer and the transverse wires of the second fabric layer are interchanged.

In a further embodiment of the invention, the transverse wires of the second fabric layer are interwoven with the longitudinal wires of the first fabric layer at the same point at which the transverse wires of the first fabric layer are interwoven with the longitudinal wires of the second fabric layer.

BRIEF DESCRIPTION OF THE DRAWINGS

The above and other features and aspects of the present invention will become more apparent upon reading the following detailed description in conjunction with the accompanying drawings, in which:

FIG. 1 shows a first composite fabric in accordance with the principles of the present invention;

FIGS. 2–4 show further embodiments of composite fabrics in accordance with the principles of the present invention.

DETAILED DESCRIPTION

Figure 5:
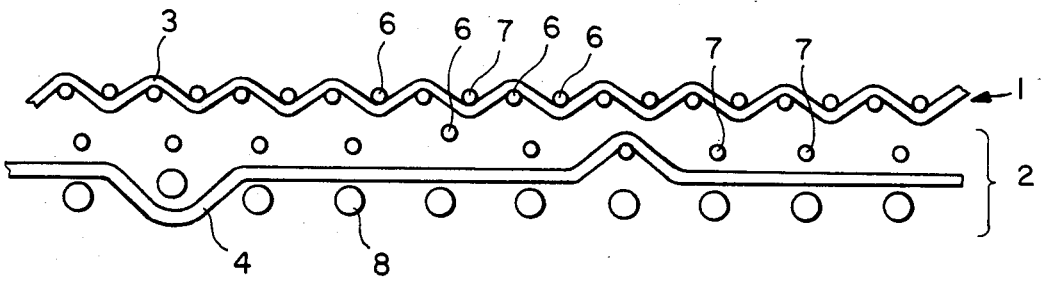
FIG. 5 shows a cross-section through the fabric or FIG. 1 perpendicular to the tranverse wires of the fabric.
Figure 6:
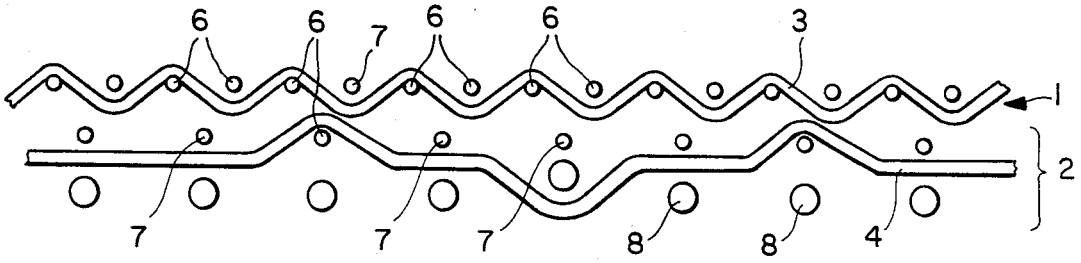
FIG. 6 shows a cross-section through the fabric of FIG. 4 perpendicular to the tranverse wires of the fabric.

FIG. 1 shows a composite fabric in which the upper fabric 1 is a single-layer plain weave of longitudinal wires 3 and transverse wires 6. The lower fabric 2, in turn, is a double layer with longitudinal wires 4 and upper transverse wires 7 and lower transverse wires 8. The lower tranverse wires 8 have long floats on the running side so that—in case of a flat woven papermachine screen—a so-called weft runner is realized. The lower fabric 2 can be a 10-harness weave.

In order to avoid paper marks, the transverse wires 6 of the fabric 1 and the upper transverse wires 7 of the fabric 2 are of equal thickness amd are made of the same material. The longitudinal wires 3 of the fabric 1 are preferably thinner and are made of a more elastic material than are the longitudinal wires 4 of the fabric 2. This is possible, since the longitudinal wires 3 of the fabric 1 serve primarily to form the paperside of the screen, while the fabric 2, like a transmission belt, serves to take up the entire driving load in the paper forming section of the paper machine. Typically, the longitudinal and transverse wires may comprise polyester filaments. Also, the longitudinal wires and particularly the transverse wires of the lowermost fabric may also comprise polyamide filaments on account of the higher wear resistance of these filaments.

In accordance with the principles of the present invention and in order to obtain as firm a connection between the fabrics 1 and 2, the interconnection of the two fabrics is effected such that the transverse wire 6 of the fabric 1, deviates from its otherwise plain weave, and passes beneath a plurality of longitudinal wires 3, shown as three wires, instead of merely under a single wire 3. Also in accordance with the invention and as shown, at this point, the upper transverse wire 7 of the fabric 2 is interwoven with the longitudinal wire 3 which was skipped by wire 6 and with which the wire 6 would normally have been interwoven had the latter followed its usual path. Hence, within a repeat pattern, the courses of the transverse wires 6 and 7 are interchanged with respect to the single longitudinal wire 3. Preferably, this interchange is repeated at regular intervals, e.g., once within each repeat pattern or within each second or third repeat pattern.

FIG. 2 shows a composite fabric similar to that of FIG. 1 in which the courses of the transverse wires 6 and 7 are interchanged along an interval greater than a single longitudinal wire. In this case, the interchange is along an interval of three longitudinal wires 3.

FIG. 3 shows a modification to the embodiment of the invention shown in FIG. 2. In FIG. 3, the transverse wire 6 of the fabric 1, along the interval in which the transverse wire 7 is woven into the longitudinal wires 3 of the fabric 1, is itself interwoven into the fabric 2 in that it passes beneath two longitudinal wires 4.

FIG. 4 shows a further embodiment of the present invention. In this embodiment, the fabric 1 is again woven in plain weave, while the fabric layer 2 is shown as an eight-harness double-layer fabric. At one position of the longitudinal wires 3 and 4, the courses of the transverse wires 6 and 7 are exactly exchanged, i.e., the upper transverse wire 7 of the fabric 2 is passed over a longitudinal wire 3 of the fabric 1, rather than beneath the corresponding longitudinal wire 4 of the fabric 2, and the transverse wire 6 of the fabric 1 passes beneath the longitudinal wire 4 now missed by the transverse wire 7, rather than over the corresponding longitudinal wire 3.

It is preferable in practicing the present invention to interweave each transverse wire of a fabric into the adjacent fabric following the interchange principle of the invention. However, in individual cases, it may be sufficient to weave only each second, third or fourth transverse wire into the adjacent fabric. Also, where a fabric comprises multiple layers, generally only the transverse wires of the external layers should be interwoven into their adjacent layers.

It is also preferable that the composite fabric of the invention be flat woven, but the principles of the invention apply to circularly woven fabric as well. In this connection, in flat woven composites the transverse wires are the weft wires and the longitudinal wires are the warp wires. In a circularly woven composite, on the other hand, the transverse wires are the warp and the longitudinal wires are the weft wires.

It is within the scope of the present invention to interconnect two or more fabric webs which are complete in themselves by weaving the longitudinal wires of one fabric layer along some distance into an adjacent fabric layer, or by the exchange along some distance of longitudinal wires of two adjacent fabric layers. However, the use of longitudinal wires for interconnection is less advantageous in flat woven composites, since the longitudinal wires are maintained under tension during thermosetting and during the use of the papermachine. This makes it difficult to preseve a uniform surface structure on the paper supporting side of the composite. The transverse wires, on the other hand, are a sort of filler material which is relatively unaffected by longitudinal tension. During thermosetting these wires are disposed transversely of the exerted longitudinal tension and form a homogeneous topographic structure despite any deviation from their original course. In circularly woven composites, however, it is the transverse wires (the warp wires) which are subject to tension during weaving. Therefore, in practicing the invention, the least difficulties are encountered when the composite fabric is flat woven and the interconnection is accomplished with the transverse wires.

In the embodiments of the invention illustrated in FIGS. 1–4, the upper fabric layer is a single-layer fabric and the lower fabric layer is a double-layer fabric. However, the composite may also comprise a double-layer upper fabric and a single-layer lower fabric, or two double-layer or multiple layer fabrics. Also, a composite fabric composed of two single-layer fabrics may be used. In the latter case, however, the different diameters of the transverse wires may give an undesirable influence on the paper supporting side of the structure.

The following is an example of a composite fabric made in accordance with the principles of the invention.

EXAMPLE

The layer of a two layers composite fabric is woven flat in plain weave with 30 longitudinal wires per centimeter and 34 transverse wires per centimeter. The longitudinal wires 3 have a diameter of 0.15 mm and are made of polyester monofilament of medium to low longitudinal stability and medium elastic modulus (Trevira 930). The transverse wires 6 also have a diameter of 0.15 mm and are made of polyester monofilament of very low elastic modulus and low thermal shrinkage (Trevira 900).

The layer 2 is an eight-harness, double-layer fabric of No. 0859 weave with long floats of the transverse wires on the running side and shortened floats on the upper side. The layer 2 is woven open with 15 longitudinal wires per centimeter and 17 transverse wires per centimeter. The longitudinal wires have a diameter of 0.30 mm and are made of polyester monofilament of a high elastic modulus. The upper transverse wires 7 of the layer 2 are made of the same material and have the same diameter as the transverse wires 6 of the fabric 1, so that the surface structure of the composite fabric on the paper side is equally uniform at the points of interconnection. The lower transverse wires 8 of the fabric 2 are made of abrasion-resistant material and alternately consist of polyester monofilament and polyamide monofilament having a diameter of 0.32 mm each.

The upper and lower fabrics 1 and 2 are interconnected as shown in FIG. 4 in that each transverse wire 6 of the fabric 1 and each upper transverse wire 7 of the fabric 2 is interchanged at each eighth longitudinal wire 3 and each fourth longitudinal wire 4, respectively.

The longer service life of the composite fabric of the invention is believed to be due to the fact that the great number of bond points between the individual fabric layers causes the layer to be firmly interconnected and to not undergo any relative movement, e.g., when passing around rolls. Therefore, there is little risk that the transverse wires interconnecting the layers are subject to special wear or to high tensile stress, owing to movement of the layers relative to one another.

It is further noted that the individual fabric layers in the composite fabric of the invention are interconnected by structural transverse wires, i.e., transverse wires participating in the formation of the fabric weave in the usual way, rather than by special binder wires. In particular, as discussed above at certain invervals, the structural transverse wires deviate from the normal pattern and are interwoven into an adjacent fabric layer by interchange with the transverse wires of the layer beneath.

In all cases, it is understood that the above-described arrangements are merely illustrative of the many possible specific embodiments which represent applications of the present invention. Numerous and varied other arrangements can be readily devised without departing from the spirit and scope of the invention.

What is claimed is:

1. Papermachine multi-layer forming fabric comprising:

a first single layer fabric (1) on the paper side being woven of longitudinal plastic wires (3) and transverse plastics wires (6);

a second double layer fabric (2) having vertically disposed layers of transverse plastic wires (7) of an upper layer and (8) of a lower layer interwoven with longitudinal plastic wires (4), the wires (8)

weaving exclusively with the wires (4) and the wires (4) and (8) being of larger diameter than the wires (3), (6) and (7);

the first and second fabrics (1) and (2) being interconnected in that at least part of the transverse wires (7) of the upper layer of the second fabric (2) are interwoven with certain longitudinal wires (3) of the first fabric (1) replacing the transverse wires (6) of the first fabric (1) in their course, the transverse wires (6) of the first fabric (1) at the point of interconnection floating beneath a plurality of longitudinal wires (3) and above longitudinal wires (4) so that the pattern of knuckles presented on the paper side of the first fabric (1) remains substantially constant.

2. Papermachine multi-layer forming fabric comprising:

a first single layer fabric (1) on the paper side being woven of longitudinal plastic wires (3) and transverse plastic wires (6);

a second double layer fabric (2) having vertically disposed layers of transverse plastic wires (7) of an upper layer and (8) of a lower layer interwoven with longitudinal plastic wires (4), the wires (8) weaving exclusively with the wires (4) and the wires (4) and (8) being of larger diameter than the wires (3), (6) and (7);

the first and second fabrics (1) and (2) being interconnected in that at least part of the transverse wires (7) of the upper layer of the second fabric (2) are interwoven with certain longitudinal wires (3) of the first fabric (1) replacing the transverse wires (6) of the first fabric (1) in their course, the transverse wires (6) of the first fabric (1) at the point of interconnection being beneath the longitudinal wires (3) and binding with the longitudinal wires (4) so that the pattern of knuckles presented on the paper side of the first fabric (1) remains substantially constant.

* * * * *